US010041298B2

(12) United States Patent
Li et al.

(10) Patent No.: US 10,041,298 B2
(45) Date of Patent: Aug. 7, 2018

(54) DETACHABLE COMBINED-TYPE DRIVE KEY FOR ROTARY DRILLING RIG POWER HEAD

(71) Applicant: XUZHOU XUGONG FOUNDATION CONSTRUCTION MACHINERY CO., LTD., Xuzhou (CN)

(72) Inventors: Xiaoliang Li, Xuzhou (CN); Ju Luo, Xuzhou (CN); Zhonghai Zhang, Xuzhou (CN); Jiguang Zhang, Xuzhou (CN); Jingwei He, Xuzhou (CN); Caifeng Wei, Xuzhou (CN)

(73) Assignee: XUZHOU XUGONG FOUNDATION CONSTRUCTION MACHINERY CO., LTD, Xuzhou (CN)

( * ) Notice: Subject to any disclaimer, the term of this patent is extended or adjusted under 35 U.S.C. 154(b) by 379 days.

(21) Appl. No.: 14/781,344

(22) PCT Filed: Apr. 26, 2013

(86) PCT No.: PCT/CN2013/074808
§ 371 (c)(1),
(2) Date: Sep. 30, 2015

(87) PCT Pub. No.: WO2014/161212
PCT Pub. Date: Jan. 9, 2014

(65) Prior Publication Data

US 2016/0032652 A1 Feb. 4, 2016

(30) Foreign Application Priority Data

Apr. 3, 2013 (CN) ..... 2013 1 0115407

(51) Int. Cl.
*E21B 3/02* (2006.01)

(52) U.S. Cl.
CPC ..... *E21B 3/02* (2013.01)

(58) Field of Classification Search
CPC ..... E21B 3/00; E21B 3/02
See application file for complete search history.

(56) References Cited

U.S. PATENT DOCUMENTS 1,856,229 A * 5/1932 Sheldon ..... E21B 3/04 173/150

FOREIGN PATENT DOCUMENTS

CN 201567950 U 9/2010
CN 201802307 U 4/2011
(Continued)

OTHER PUBLICATIONS

Machine translation dated Dec. 4, 2017 of Yu, Qingda, Chinese Pat No. CN201567950. (Year: 2010).*
(Continued)

*Primary Examiner* — Caroline N Butcher
(74) *Attorney, Agent, or Firm* — Anova Law Group, PLLC

(57) ABSTRACT

A detachable and combined drive key of a power head of a rotary drilling rig is provided. The drive key includes torque transfer keys and a pressure transfer key. Each torque transfer key is respectively assembled on a key groove on an inner wall of the drive sleeve. The pressure transfer key is assembled at a bottom of a drive sleeve and includes a circular ring structure and a plurality of pressure pads. Each pressure pad has a width less than the torque transfer key. A central surface of each pressure pad is aligned with a central surface of each torque transfer key. The drive sleeve, the torque transfer keys, and the pressure transfer key are combined to form an integrated drive key with a same circular cross-section.

4 Claims, 3 Drawing Sheets

(56) References Cited

FOREIGN PATENT DOCUMENTS

| | | | |
|---|---|---|---|
| CN | 202280751 | U | 6/2012 |
| CN | 202300191 | U | 7/2012 |
| CN | 203188903 | U | 9/2013 |
| JP | H06185283 | A | 7/1994 |

OTHER PUBLICATIONS

Machine translation dated Dec. 4, 2017 of Fangxiao et al., Chinese Pat No. CN201802307. (Year: 2011).*
The World Intellectual Property Organization (WIPO) International Search Report for PCT/CN2013/074808 dated Jan. 2, 2014.

* cited by examiner

DETACHABLE COMBINED-TYPE DRIVE KEY FOR ROTARY DRILLING RIG POWER HEAD

CROSS-REFERENCES TO RELATED APPLICATIONS

This application claims priority of PCT Application No. PCT/CN2013/074808, filed on Apr. 26, 2013, which claims priority of Chinese Patent Application No. CN201310115407.4, filed on Apr. 3, 2013, the entire content of which is incorporated herein by reference.

FIELD OF THE DISCLOSURE

The present disclosure generally relates to the field of rotary drilling rig and, more particularly, relates to a detachable and combined drive key of a power head of a rotary drilling rig.

BACKGROUND

A rotary drilling rig (or rotary drilling machine) is a type of piling equipment for coring. It mainly utilizes a power head to drive the drill rod, through which the power can be transferred to the drill tool (i.e., drill bit) for drilling. When the rotary drilling rig uses a friction-type drill rod, the power head of the rotary drilling rig relies on the two sides along the vertical direction of the drive key to realize forward and reverse rotation of the drill rod and transfer applied pressure. Therefore, after operating for some time the two sides along the vertical direction of the drive key can be worn down and become inclined. The side that drives the forward rotation of the drill rod is especially susceptible to wear and tear, and can be seriously abraded, causing the drive key of the power head of the rotary drilling rig to gradually lose its functions, thereby affecting the performance of the rotary drilling rig. When the rotary drilling rig uses machine lock drill rod, not only the two sides along the vertical direction of the drive key but also the pressure applying surface under the drive key can be worn down and become inclined. Thus, wear of the drive key is a common problem in rotary drilling rig equipment.

Currently, the drive key of the power head of the rotary drilling rig designed and produced by domestic as well as international manufacturers generally uses a three-piece drive key to realize driving and applying pressure to the drill rod. There are mainly two structural forms of the drive key: the welded and the detachable. The welded drive key cannot be replaced readily in the field when it is worn down. It has to be sent back to the manufacturer for reconditioning, thereby resulting in higher cost and longer service time.

The detachable drive key can be replaced in the field, however, there exist two problems when machine lock drill rod is used: 1) if a single drive key bears the applied pressure on its bottom, drive key bottom may be squeezed, warped, and deformed, the bolts of the drive key may be loosening, bending, or even breaking, thereby causing high failure rate; 2) if any of the two sides along the vertical direction of the drive key and the pressure applying side under the drive key has been worn down, the whole drive key unit has to be dissembled and replaced, thereby resulting in high replacing frequency and high cost. In addition, because of the restrictions of the structural space and the field conditions, it is very difficult to dissemble and assemble the drive key.

BRIEF SUMMARY OF THE DISCLOSURE

To overcome the above-mentioned technical problems of the prior art, the present disclosure provides a detachable and combined drive key of a power head of a rotary drilling rig. As disclosed, disassembling of the whole drive key unit is not required, and only the worn keys need to be detached, replaced, and readily reconditioned, thereby effectively reducing the maintenance cost.

To achieve the above-mentioned objectives, the present disclosure provides a detachable and combined drive key of a power head of a rotary drilling rig. The detachable and combined drive key includes a first bolt (1), a first locking washer (2), a drive sleeve (3), a second bolt (4), a washer (5), a guide ring (6), torque transfer keys (9), and a pressure transfer key (10). The guide ring (6) is assembled on top of the drive sleeve (3) through the second bolt (4) and the washer (5). The drive sleeve (3) is secured on the power head of the rotary drilling rig through the first bolt (1) and the first locking washer (2). The drive sleeve (3) has an inner wall configured with a plurality of key grooves. The torque transfer key (9) is respectively assembled on each of the plurality of key grooves on the inner wall of the drive sleeve (3). A central surface of each of the plurality of key grooves is evenly distributed along a circumferential surface of the drive sleeve (3). The pressure transfer key (10) is assembled at a bottom of the drive sleeve (3) and includes a circular ring structure (13) and a plurality of pressure pads (14), the number of the pressure pads (14) being the same for the number of the torque transfer keys (9). The plurality of pressure pads (14) has a top surface coplanar with a top surface of the circular ring structure (13). The plurality of pressure pads (14) are evenly distributed on an inner wall of the circular ring structure (13) and each corresponding to the torque transfer key (9). Each of the plurality of pressure pads (14) has a width less than a width of the torque transfer key (9). The top surface of each pressure pad (14) of the pressure transfer key (10) is coaxially aligned and in contact with a bottom surface of each torque transfer key (9), and the drive sleeve (3), the torque transfer keys (9), and the pressure transfer key (10) are combined to form an integrated drive key with a same circular cross-section.

Optionally, each pressure pad (14) has the width less than the width of the torque transfer key (9) by about 15 mm to about 20 mm.

Optionally, the torque transfer key (9) is secured through a first screw (7) and a protection sleeve (8).

Optionally, the pressure transfer key (10) is assembled at the bottom of the drive sleeve (3) through a second screw (11) and a second locking washer (12).

Optionally, the inner wall of the drive sleeve (3) is configured with three key grooves; the torque transfer key (9) is respectively assembled on each of the three key grooves on the inner wall of the drive sleeve (3); and the central surface of each of the three key grooves is evenly distributed by a spacing of 12° along a circumferential surface of the drive sleeve (3).

Compared with conventional drive key, the present disclosure provides torque transfer keys and pressure transfer key without requiring disassembling of the whole unit of the drive key. When wear is observed during operation, the worn keys can be independently disassembled and replaced, and the replacement is quick and easy, thereby lowering the maintenance cost. Because the drive sleeve, torque transfer keys and pressure transfer key are combined to form an integrated circular ring surface, circular ring structure of the pressure transfer key may effectively transfer and dissipate the counteracting force exerted on the bottom of the torque transfer keys by the drill rod rotary table. Therefore, it can be avoided when the applied pressure/force on an individual/single drive key causes the bottom of the torque transfer keys to be squeezed, edge-warped, and deformed. In addition, it can also be avoided when the applied pressure/force on the individual/single drive key causes loosening, bending, and even breaking of screws of the drive key. Failure rate can then be lowered.

Other aspects or embodiments of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

Figure 1:
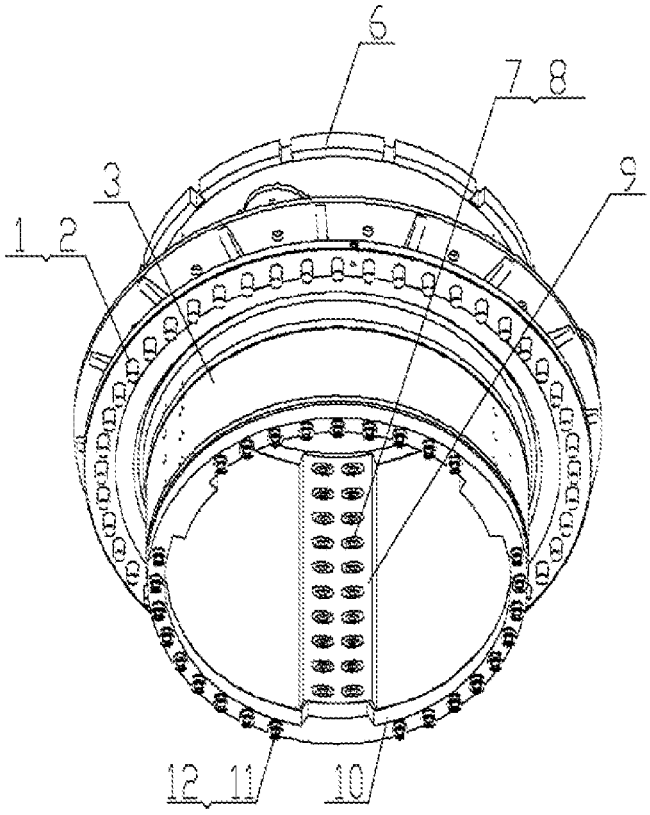
FIG. 1 illustrates an exemplary detachable and combined drive key of a power head of the rotary drilling rig consistent with various embodiments of the present disclosure.

The numerical labels in FIGS. 1-5 include 1: bolt I (first bolt); 2: locking washer I (first locking washer); 3: drive sleeve; 4: bolt II (second bolt); 5: washer; 6: guide ring; 7: screw I (first screw); 8: protection sleeve; 9: torque transfer key; 10: pressure transfer key; 11: screw II (second screw); 12: locking washer II (second locking washer); 13: circular ring structure; and 14: pressure pad.

DETAILED DESCRIPTION

Reference will now be made in detail to exemplary embodiments of the disclosure, which are illustrated in the accompanying drawings. Wherever possible, the same reference numbers will be used throughout the drawings to refer to the same or like parts.

The present disclosure provides a detachable and combined drive key of a power head of a rotary drilling rig. The detachable and combined drive key includes a first bolt (1), a first locking washer (2), a drive sleeve (3), a second bolt (4), a washer (5), and a guide ring (6).

The guide ring (6) is assembled on top of the drive sleeve (3) through the second bolt (4) and the washer (5). The drive sleeve (3) is secured on the power head of the rotary drilling rig through the first bolt (1) and the first locking washer (2). The detachable and combined drive key further includes torque transfer keys (9) and a pressure transfer key (10).

In one embodiment, the torque transfer key (9) is respectively assembled on each of a plurality of key grooves, e.g., about three key grooves or more, on an inner wall of the drive sleeve (3). The central surface of each of the exemplary three key grooves is evenly distributed by about 120° along a circumferential surface of the drive sleeve (3). The pressure transfer key (10) is assembled at a bottom of the drive sleeve (3) and includes a circular ring structure (13) and exemplary three pressure pads (14), accordingly. For example, the exemplary three pressure pads (14) are evenly distributed by about 120° on an inner wall of the circular ring structure (13). Each of the exemplary three pressure pads (14) has a width less than the torque transfer key (9), for example, by about 15 mm to about 20 mm. A central surface of each of the exemplary three pressure pads (14) is aligned with a central surface of each of the torque transfer keys (9). The drive sleeve (3), the torque transfer keys (9), and the pressure transfer key (10) are combined to form an integrated drive key with a same circular cross-section.

Optionally, the torque transfer key (9) is secured through a first screw (7) and a protection sleeve (8). Optionally, the pressure transfer key (10) is assembled at the bottom of the drive sleeve (3) through a second screw (11) and a second locking washer (12).

In an exemplary embodiment, referring to FIG. 1, a detachable and combined drive key of a power head of the rotary drilling rig includes bolt I (1), locking washer I (2), drive sleeve (3), bolt II (4), washer (5) and guide ring (6). The guide ring (6) can be assembled on top of the drive sleeve (3) through bolt II (4) and washer (5). The drive sleeve (3) can be secured on the power head of the rotary drilling rig through bolt I (1) and locking washer I (2).

Figure 2:
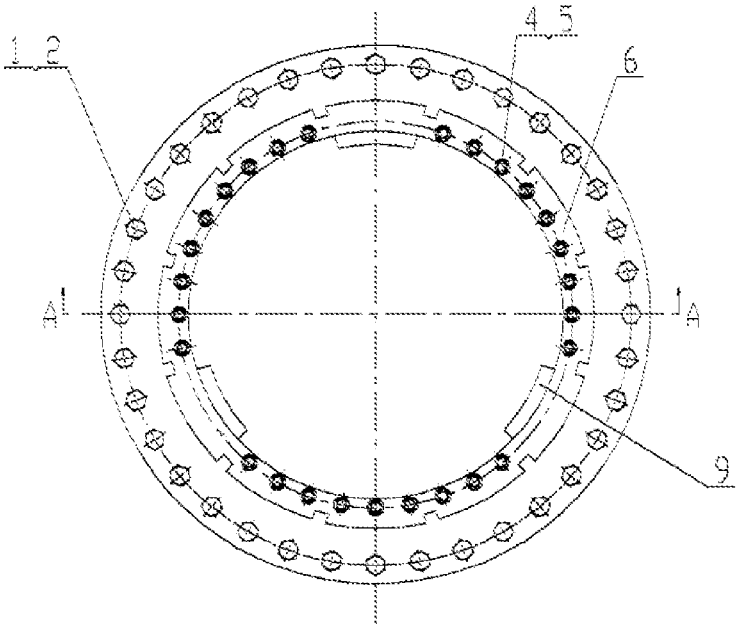
FIG. 2 illustrates a schematic of the top view of the exemplary detachable and combined drive key of a power head of the rotary drilling rig consistent with various embodiments of the present disclosure.
Figure 3:
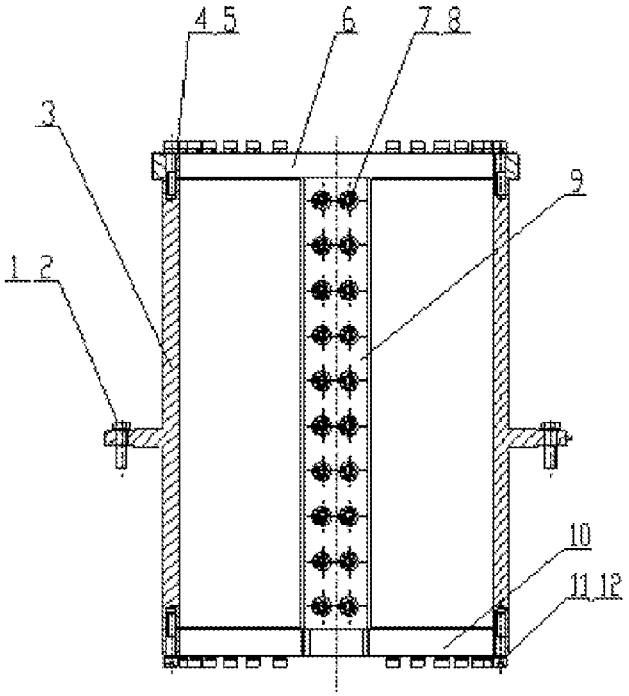
FIG. 3 illustrates a schematic of the cross-sectional view along A-A direction in FIG. 2 consistent with various embodiments of the present disclosure.
Figure 4:
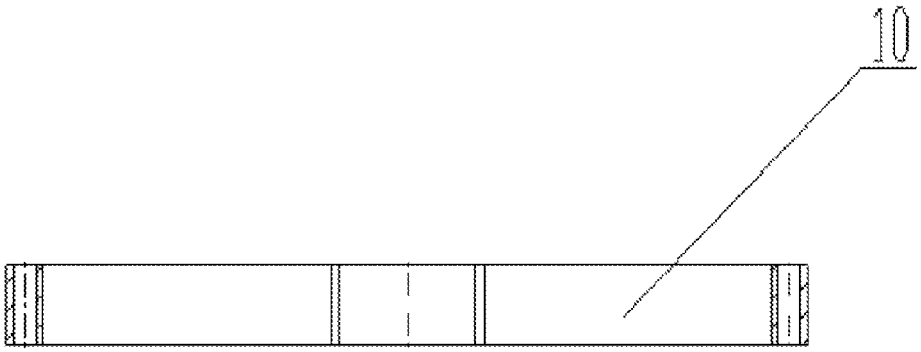
FIG. 4 illustrates a schematic of the front view of an exemplary pressure transfer key consistent with various embodiments of the present disclosure.
Figure 5:
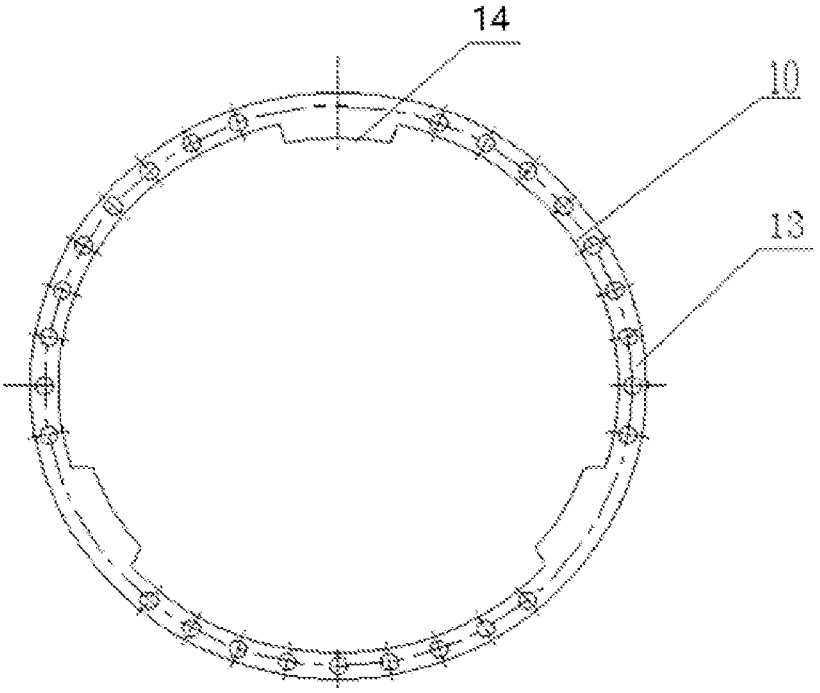
FIG. 5 illustrates a schematic of the exemplary pressure transfer key of FIG. 4 consistent with various embodiments of the present disclosure.

Referring to FIGS. 2 to 4, the drive key also includes torque transfer key (9) and pressure transfer key (10). The inner wall of the drive sleeve can have three key grooves, and the central surfaces of the three key grooves are evenly distributed with a spacing of 120° along the circumferential surface. All the three key grooves have torque transfer keys (9) that are secured through screw I (7) and sleeve (8). Screw I (7) and sleeve (8) can effectively secure the torque transfer key (9) in the key groove. The pressure transfer key (10) can be assembled at the bottom of the drive sleeve (3) through screw II (11) and locking washer II (12). The screw II (11) can secure the drive sleeve (3) and the locking washer II (12) can effectively prevent the pressure transfer key (10) from loosing, thereby ensuring that the pressure transfer key and the drive sleeve (3) are tightly secured. Referring to FIG. 5, the pressure key (10) includes a circular ring structure (13) and three pressure pads (14). The three pressure pads (14) are distributed evenly with a spacing of 120° the inner wall of the circular ring structure (13). In addition, the width of the pressure pad (14) is about 15 mm to about 20 mm less than that of the torque transfer key (9), thereby ensuring the three pressure pads (14) on the pressure transfer key (10) can only transfer the pressure, not the torque. The central surfaces of the three pressure pads (14) on the pressure transfer key (10) are aligned with the three central surfaces of the torque transfer keys (9), therefore the drive sleeve (3), torque transfer keys (9) and pressure transfer key (10) are combined to form an integrated drive key that has the same and/or single circular cross-section.

The circular ring structure (13) of the pressure transfer key (10) may effectively transfer and dissipate the counter-acting force exerted on the bottom of the torque transfer keys by the drill rod rotary table. Therefore, it can be avoided when the applied pressure/force on an individual/single drive key causes the bottom of the torque transfer keys to be squeezed, edge-warped, and deformed. In addition, it can also be avoided when the applied pressure/force on the individual/single drive key causes loosening, bending, and even breaking of screw I (1) of the drive key. Failure rate can then be lowered.

When the rotary drilling rig uses friction-type drill rod, the three torque transfer keys (9) on the inner wall of the drive sleeve (3) are used to drive the drill rod for the forward and reverse rotation. The torque transfer key (9) may be worn down after operating for some time. In this case, the guide ring (6) and pressure transfer key (10) on both ends of the drive sleeve (3) can be dissembled, and then the worn torque transfer key (9) can be dissembled and replaced. When the rotary drilling rig uses machine lock type drill rod, the three torque transfer keys (9) on the inner wall of the drive sleeve (3) are used to drive the drill rod for the forward and reverse rotation and the pressure transfer key (10) is used to transfer applied pressure. The worn keys can be dissembled and replaced independently.

As such, the present disclosure provides independent torque transfer keys and pressure transfer key, which are detachable, thereby enabling easy reconditioning, quick replacement, and low maintenance cost.

The embodiments disclosed herein are exemplary only. Other applications, advantages, alternations, modifications, or equivalents to the disclosed embodiments are obvious to those skilled in the art and are intended to be encompassed within the scope of the present disclosure.

What is claimed is:

1. A detachable and combined drive key of a power head of a rotary drilling rig, comprising:

a first bolt (1), a first locking washer (2), a drive sleeve (3), a second bolt (4), a washer (5), a guide ring (6), torque transfer keys (9), and a pressure transfer key (10), wherein:

the guide ring (6) is assembled on top of the drive sleeve (3) through the second bolt (4) and the washer (5), the drive sleeve (3) is secured on the power head of the rotary drilling rig through the first bolt (1) and the first locking washer (2), the torque transfer keys (9) are respectively assembled on an inner wall of the drive sleeve (3), using a first screw (7) and a protection sleeve, a central surface of each of the torque transfer keys (9) is evenly distributed along an inner wall surface of the drive sleeve (3), the pressure transfer key (10) connects onto the drive sleeve (3) from under a bottom of the drive sleeve (3), the pressure transfer key (10) includes a circular ring structure (13) and a plurality of pressure pads (14), one pressure pad (14) corresponding to one torque transfer key (9), in the pressure transfer key (10), the plurality of pressure pads (14) each has a top surface coplanar with a top surface of the circular ring structure (13), and the plurality of pressure pads (14) are evenly distributed on an inner wall of the circular ring structure (13), each of the plurality of pressure pads (14) has a width less than a width of the corresponding torque transfer key (9), the top surface of each pressure pad (14) of the pressure transfer key (10) is coaxially aligned and in contact with a bottom surface of each torque transfer key (9), and the drive sleeve (3), the torque transfer keys (9), and the pressure transfer key (10) are combined to form an integrated drive key with a same circular cross-section.

2. The detachable and combined drive key according to claim 1, wherein each pressure pad (14) has the width less than the width of the corresponding torque transfer key (9) by about 15 mm to about 20 mm.

3. The detachable and combined drive key according to claim 1, wherein the pressure transfer key (10) is assembled at the bottom of the drive sleeve (3) through a second screw (11) and a second locking washer (12).

4. The detachable and combined drive key according to claim 1, wherein:

the inner wall of the drive sleeve (3) is configured with three key grooves, three key grooves corresponding to three torque transfer keys (9), wherein each of the three torque transfer keys (9) is respectively assembled on each of the three key grooves on the inner wall of the drive sleeve (3), and the central surface of each of the three key grooves is evenly distributed by about 120° along the inner wall surface of the drive sleeve (3).

* * * * *